US006026804A

United States Patent [19]

Schardt et al.

[11] Patent Number: 6,026,804

[45] Date of Patent: Feb. 22, 2000

[54] HEATER FOR FLUIDS

[75] Inventors: David L. Schardt, Brentwood; Kendall R. Carter, Lascassas, both of Tenn.; John M. Stallins, Louisville, Ky.; Charles E. Taylor, Ashland City, Tenn.

[73] Assignee: H-Tech, Inc., Wilmington, Del.

[21] Appl. No.: 08/801,077

[22] Filed: Feb. 14, 1997

Related U.S. Application Data

[63] Continuation-in-part of application No. 08/579,692, Dec. 28, 1995, abandoned.

[51] Int. Cl.[7] ..... E01L 19/47

[52] U.S. Cl. ..... 126/344; 126/350 R; 126/351; 165/133; 165/178; 165/173

[58] Field of Search ..... 126/344, 350 R, 126/93, 75 R, 351; 122/14, 18, 19, 367.3, 235.15, 257, 262, 275, 236; 165/135, 176, 174, 178, 175, 173

[56] References Cited

U.S. PATENT DOCUMENTS

| | | | |
|---|---|---|---|
| 100,243 | 2/1870 | Sturtevant | 29/890.038 |
| 513,620 | 1/1894 | Phillips | 122/512 |
| 540,987 | 6/1895 | Jones | 110/337 |
| 1,171,899 | 2/1916 | Still | 228/153 |
| 1,320,652 | 11/1919 | Sonneborn | 29/890.043 |
| 1,363,208 | 12/1920 | Serck | 29/890.043 |
| 1,539,212 | 5/1925 | Seemiller | 122/512 X |
| 1,809,210 | 6/1931 | McLimans | 432/248 |
| 2,191,631 | 2/1940 | Shutts et al. | 29/DIG. 39 |
| 2,349,792 | 5/1944 | Rosenblad | 285/15 |
| 3,257,710 | 6/1966 | Brown et al. | 165/134.1 |
| 3,268,989 | 8/1966 | Erwin et al. | 29/458 X |
| 3,446,566 | 5/1969 | Miller | 431/349 |
| 3,489,209 | 1/1970 | Johnson | 165/133 |
| 3,501,258 | 3/1970 | Vales | 431/354 |
| 3,568,764 | 3/1971 | Newman et al. | 165/134.1 |
| 3,628,603 | 12/1971 | Fieni | 165/151 |
| 3,710,473 | 1/1973 | McElwain et al. | 29/509 X |
| 3,797,477 | 3/1974 | Ramey | 126/307 A |
| 3,800,748 | 4/1974 | Schindler et al. | 122/367.3 |
| 3,991,941 | 11/1976 | Dornbach, Jr. | 239/552 |
| 4,011,394 | 3/1977 | Shelley | 273/137 |
| 4,030,541 | 6/1977 | Gross et al. | 165/175 |
| 4,075,106 | 2/1978 | Yamazaki | 210/487 |
| 4,091,768 | 5/1978 | Widdershoven | 122/367.3 |
| 4,159,741 | 7/1979 | Nonnenmann et al. | 165/173 |
| 4,190,101 | 2/1980 | Hartmann | 165/82 |
| 4,231,424 | 11/1980 | Moranne | 165/104.31 |
| 4,266,604 | 5/1981 | Sumikawa et al. | 165/176 |
| 4,290,413 | 9/1981 | Goodman et al. | 126/624 |

(List continued on next page.)

FOREIGN PATENT DOCUMENTS

| | | |
|---|---|---|
| 2310968 | 9/1974 | Germany . |
| 2846455 | 10/1979 | Germany . |
| 3932855 | 12/1990 | Germany . |

OTHER PUBLICATIONS

STA –RITE SR Pool and Spa Heater Natural Gas/LP Gas Owner's Manual (Rev. 4 Apr., 15, 1997).

*Primary Examiner*—Larry Jones
*Attorney, Agent, or Firm*—Selitto & Associates

[57] ABSTRACT

A fluid heater includes a housing, a burner unit disposed in a bottom portion of the housing for burning combustible fuel, a combustion chamber disposed within the housing where the fuel is burned and a heat exchanger disposed substantially within the housing over the combustion chamber. The heat exchanger absorbs heat generated from burning the fuel and conducts the heat to a fluid to be heated. The heat exchanger includes a pair of spaced, parallel, stainless steel tubesheets with a plurality of tubes running therebetween and sealingly received within mating apertures in each of the tubesheets. A plastic front header and a plastic rear header are removably attached to the tubesheets distal to said tubes. The apertures in the tubesheets preferably have forged flanges for increasing the surface contact area with the heat exchanger tubes. The heat exchanger is corrosion resistant due to the combination of corrosion-resistant tubesheets, tubes and headers.

47 Claims, 8 Drawing Sheets

U.S. PATENT DOCUMENTS

| | | | |
|---|---|---|---|
| 4,314,927 | 2/1982 | Theysohn et al. | 524/100 |
| 4,316,503 | 2/1982 | Kurachi et al. | 165/175 |
| 4,344,386 | 8/1982 | Black | 122/19 |
| 4,421,066 | 12/1983 | Gordbegli | 122/264 |
| 4,559,688 | 12/1985 | Abu-Isa et al. | 156/344 X |
| 4,561,421 | 12/1985 | Hwang et al. | 126/110 R |
| 4,576,223 | 3/1986 | Humpolik et al. | 165/79 |
| 4,600,051 | 7/1986 | Wehrman | 165/149 |
| 4,615,385 | 10/1986 | Saperstein et al. | 165/175 |
| 4,625,793 | 12/1986 | Cadars | 165/151 |
| 4,678,026 | 7/1987 | Lenz et al. | 165/67 |
| 4,739,828 | 4/1988 | Bayer et al. | 165/173 |
| 4,809,622 | 3/1989 | Schiferi | 110/336 |
| 4,852,324 | 8/1989 | Page | 52/378 X |
| 4,889,061 | 12/1989 | McPherson et al. | 110/336 |
| 4,940,086 | 7/1990 | Stay | 165/173 |
| 4,967,836 | 11/1990 | Nakamura | 165/173 |
| 5,107,924 | 4/1992 | Herbert et al. | 165/173 |
| 5,122,055 | 6/1992 | Yamaguchi | 432/76 |
| 5,123,482 | 6/1992 | Abraham | 165/173 |
| 5,150,520 | 9/1992 | DeRisi | 29/890.043 |
| 5,160,474 | 11/1992 | Huff | 264/255 |
| 5,178,124 | 1/1993 | Lu et al. | 126/110 R |
| 5,195,582 | 3/1993 | Haase | 165/173 |
| 5,201,368 | 4/1993 | Kroetsch | 165/173 |
| 5,216,743 | 6/1993 | Seitz | 392/490 |
| 5,305,826 | 4/1994 | Couetoux | 165/103 |
| 5,311,934 | 5/1994 | Potier | 165/149 |
| 5,318,007 | 6/1994 | Afshar | 126/350 R |

HEATER FOR FLUIDS

CROSS REFERENCE TO RELATED APPLICATIONS

This is a continuation-in-part of application Ser. No. 08/579,692 filed Dec. 28, 1995, abandoned.

FIELD OF THE INVENTION

The present invention relates to heaters, and more particularly to heaters suitable for heating fluids such as water.

BACKGROUND OF THE INVENTION

Various types of heaters have been proposed over the years for heating fluids. Most, if not all, employ a heat exchanger disposed proximate a source of heat through which the fluid to be heated passes. For example, residential heating systems employing water-filled radiators typically have a furnace unit wherein a combustible, such as natural gas, is burned in a combustion chamber. In gas furnaces, the combustible is burned by a burner unit which may include a plurality of elongated tubes with openings along an upper extent thereof for distributing a mixture of air and gas along the length of the tube for burning as it exits the openings. In this manner, the surface area over which combustion takes place is matched to the general surface area profile presented by a heat exchanger unit.

A heat exchanger in the form of a metal conduit through which the water to be heated may pass is positioned above the burning gas in order to absorb the heat of combustion and conduct it to the water passing through the conduit. To increase the efficiency of heat transfer, the heat exchanger is configured to maximize exterior surface area exposed to the heat of combustion, as well as the internal surface area in contact with the water. Many heat exchangers utilize metal fins on the conduit for this purpose. One of the more common forms of heat exchanger is the traditional, parallel tube heat exchanger wherein a plurality of tubes passing over the combustion chamber of a heater communicate with manifolds at either end. The flow through the conduit is circuitous, passing back and forth through the tubes from one manifold to the other gathering heat from the combustion chamber and exiting from an outlet port on one of the manifolds to supply a heated fluid, e.g., to a radiator system. The same type of heat exchanger has been employed for heating the water in swimming pools and for other fluid heating purposes.

Many variations on the above described heat exchanger have been proposed for the purpose of increasing efficiency, lowering the costs of production and otherwise improving existing heater designs. For example, U.S. Pat. No. 5,178,124 to Lu et al. discloses a hot air heater with a heat exchanger having a primary portion composed of a plurality of "S" shaped metal tubes which receive the products of combustion that are ultimately vented to the atmosphere. A plastic heat exchanger having a plurality of tubes or channels that communicate at ends thereof with first and second manifolds receives the combustion products from the "S" shaped tubes after the gases have lost sufficient heat so as not to constitute a threat of melting to the plastic heat exchanger. This configuration differs from the previously described fluid heaters, in that the pathways for the products of combustion and the heat transfer medium are interchanged, i.e., the combustion products rather than the transfer medium are directed through the interior conduit of the heat exchanger.

Heat exchangers, per se, have diverse applications, e.g., for use as radiators for cooling internal combustion engines. In U.S. Pat. No. 5,305,826 to Couetoux, a radiator configuration is disclosed wherein a header manifold has a temperature responsive double-acting valve for controlling the flow through the radiator. A first valve portion restricts flow through the entire radiator while a second portion interacting with an aperture in a manifold divider bulkhead permits fluid to exit the radiator without passing through the core. In this manner, the temperature responsive valve performs a thermostatic control function for altering the cooling efficiency of the heat exchanger in response to cooling requirements.

Plastic is a corrosion-resistant, light and economical material that has wide application for manufactured goods. In recent years it has been recognized that some heat-resistant plastics can be used for heat exchangers or parts thereof in certain applications. For example, U.S. Pat. No. 3,628,603 to Fieni discloses an automobile radiator having header tanks formed from molded plastic. U.S. Pat. No. 3,489,209 to H. G. Johnson relates to a heat exchanger having plastic and metal components and U.S. Pat. No. 4,290,413 to Goodman et al. discloses a solar energy collector formed from plastic. U.S. Pat. No. 5,216,743 to Seitz discloses a thermoplastic heat exchanger used for heating fluids via a pair of electric heating elements that are inserted within the body of the plastic heat exchanger.

While plastic components and plastic heat exchangers have been utilized in low heat transfer applications, such as in an automobile radiator where heated water is cooled by contact with the air and/or in a solar collector where water is heated by exposure to sunlight, plastic has typically not been utilized in applications where the plastic component is exposed to the direct heat of combustion and/or high pressures. In those conditions, even heat-resistant plastics are subject to weakening and deformation.

In addition to the efforts to improve the composition of heat exchangers to produce more economical and reliable products, heat exchanger designers have sought to improve the tube sheets and the tube sheet-to-tube connections to provide lightweight heat exchangers with good integrity. It was recognized, for example in U.S. Pat. No. 513,620 to Phillips, that a tube sheet could be formed with protruding nipples or bosses surrounding the tube holes to increase the area of contact between tubes the tube sheet. In this manner, a thinner tube sheet could be utilized to provide the same sealing relationship as one formed from thicker stock. This basic concept has been expanded upon over the years and refined by various heat exchanger designers, such as in U.S. Pat. No. 4,159,741 to Nonnenmann et al. and in U.S. Pat. No. 4,316,503 to Kurachi et al. In both Nonnenmann et al. '741 and Kurachi et al. '503, the nipples or flanges formed in the tube sheet have very specific configurations for providing an improved seal against the inserted tubes to permit the solderless sealing of the tube in the tubesheet hole. Solderless sealing may be accomplished by the internal expansion of the tube after it has been inserted into the tubesheet hole and is particularly useful in the art of making automobile radiators utilizing relatively thin gauge copper or brass.

Like heat exchangers, combustion chambers or fire boxes have many uses, such as in kilns and furnaces, and have been the subject of various designs and proposals for improvement. U.S. Pat. No. 4,889,061 to McPherson et al., discloses a refractory lined burning pit for incinerating waste materials. The pit liner includes a framework of structural steel to which is fastened a plurality of refractory panels. In Schiferi, U.S. Pat. No. 4,809,622, a slot forge is formed from a plurality of elongated insulation logs held in place by a supporting framework. In Yamaguchi, U.S. Pat. No. 5,122,055, a kiln is described that utilizes vertical and horizontal framing members. The outer plates of the kiln are clamped to the framework by plates that permit thermal expansion to take place without effecting the overall length of the kiln.

U.S. Pat. No. 4,011,394 to Shelley discloses a kiln construction employing an adjustable tie bar for clamping multiple layers of a kiln wall together. U.S. Pat. No. 540,987 to Jones and U.S. Pat. No. 1,809,210 to McLimans each illustrate the old expedient of using metal buckstays to support furnace walls formed of masonry units. U.S. Pat. No. 4,852,324 to Page shows a variable angle corner support for supporting the corners formed by abutting refractory panels in, e.g., a furnace.

As with heat exchangers and combustion chambers, numerous burner assembly configurations are extant. For example, German Offenlegungschrift 2,310,968 illustrates a sheetmetal burner holder having the capacity to support a plurality of individual burner elements. Each of a plurality of apertures in the sheetmetal holder for connecting to a gas inlet port of a corresponding burner has diametrically opposed notches which may hold tabs projecting from the burner element. German Offenlegungschrift DE 3932-855-A1 diagrammatically shows a burner tube affixed to a pipe extending from a vertical surface. U.S. Pat. No. 3,501,258 to Vales discloses a more conventional arrangement wherein a plurality of individual gas burner tubes are supported on a framework.

Notwithstanding the substantial efforts that have been expended to produce more efficient and economical fluid heaters and to improve heat exchangers, fireboxes and burner assemblies, each of the foregoing still have attributes that are not desirable. For example, the conventional metal manifold units that are used in forming tube-type heat exchangers are heavy, expensive to manufacture, difficult to integrate into plastic piping systems due to different rates of thermal expansion, and impede fluid flow therethrough because of rough interior surfaces. Cast iron has been utilized in heat exchangers for economic reasons but when subjected to even mildly corrosive liquids oxidizes or dissolves. Traditional combustion chamber construction is generally unwieldy, requiring the use of cementious or other hardening fireproof sealers to seal the units composing the firebox. Known burner assemblies are typically complex and heavy employing multiple elements that are expensive to manufacture and assemble.

Accordingly, the present invention is directed to resolving the aforementioned limitations that one would encounter in conventional fluid heaters and their constituent components.

SUMMARY OF THE INVENTION

The problem and disadvantages associated with conventional devices and methods utilized to heat fluids are overcome by the present invention which includes a fluid heater with a housing, a burner unit disposed in a bottom portion of the housing for burning combustible fuel, a combustion chamber disposed within the housing where the combustible fuel is burned and a heat exchanger disposed substantially within the housing over the combustion chamber. The heat exchanger absorbs heat generated from burning the combustible fuel and conducts the heat to a fluid to be heated. The heat exchanger includes a pair of spaced, parallel, stainless steel tubesheets with a plurality of tubes running therebetween and sealingly received within mating apertures in each of said tubesheets. A plastic front header and a plastic rear header are removably attached to the tubesheets distal to the tubes. The heat exchanger has an inlet and an outlet for receiving and discharging, respectively, the fluid to be heated.

BRIEF DESCRIPTION OF THE FIGURES

For a better understanding of the present invention, reference is made to the following detailed description of an exemplary embodiment considered in conjunction with the accompanying drawings, in which.

DETAILED DESCRIPTION OF THE FIGURES

Figure 1:
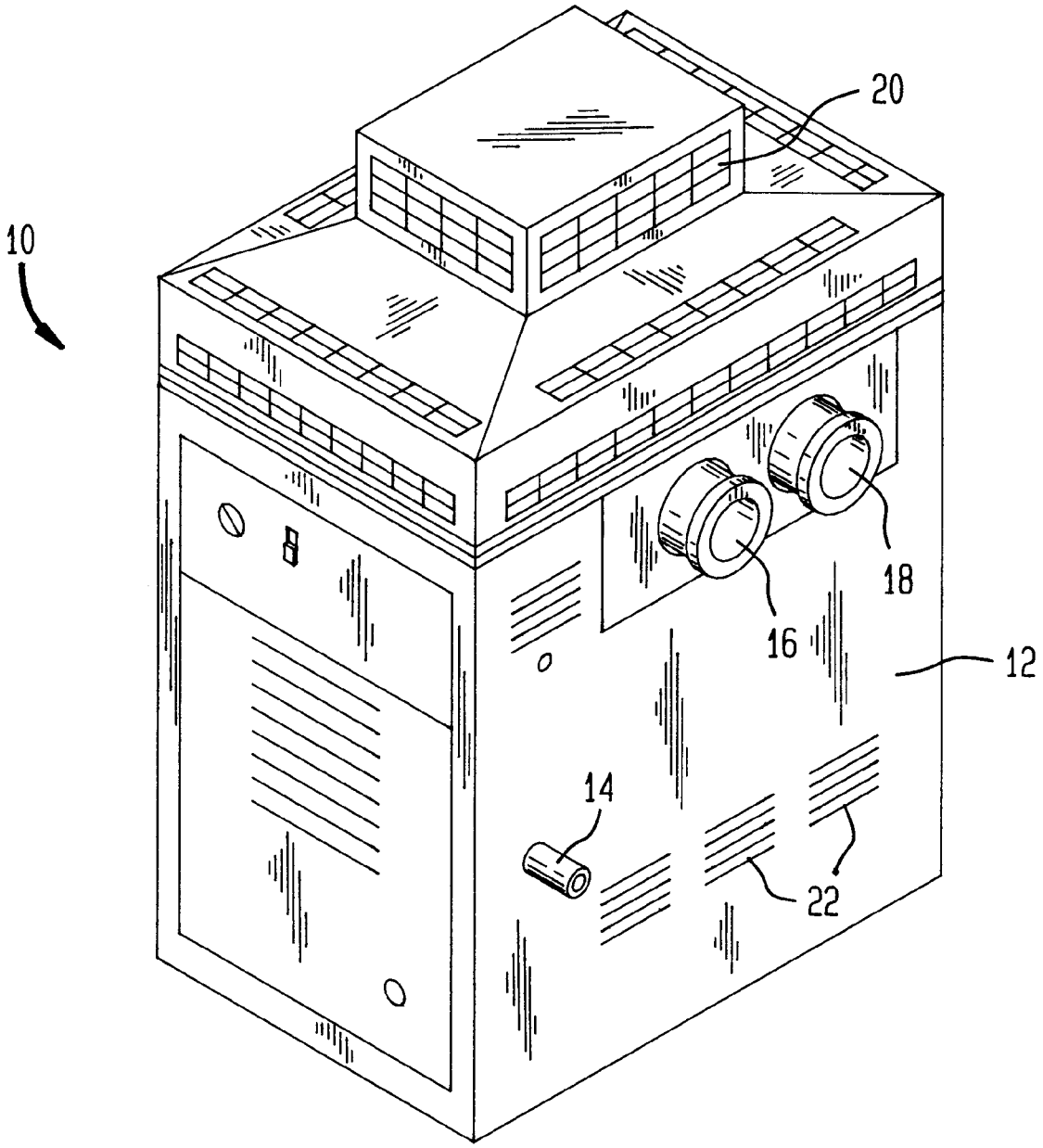
FIG. 1 is a perspective view of a fluid heater in accordance with an exemplary embodiment of the present invention.

FIG. 1 shows a heater 10 suitable for heating a fluid, such as water, for the purpose of, e.g., heating a swimming pool. The heater has an outer housing 12 formed from sheetmetal. A fuel supply line 14 supplies a combustible, such as natural gas, to the heater 10. A water inlet 16 receives water to be heated and a water outlet 18 discharges hot water to the swimming pool (not shown). Combustion by-products are vented to the atmosphere via an exhaust vent 20. Depending upon the fuel used and the heater location, e.g., indoors or out-of-doors, the heater may be connected to a flue pipe or may vent directly to the atmosphere. A plurality of air vents 22 permits air circulation through the housing 12 to remove waste heat lost to the housing preventing it from becoming unacceptably warm to the touch and also supplying air for combustion.

Figure 2:
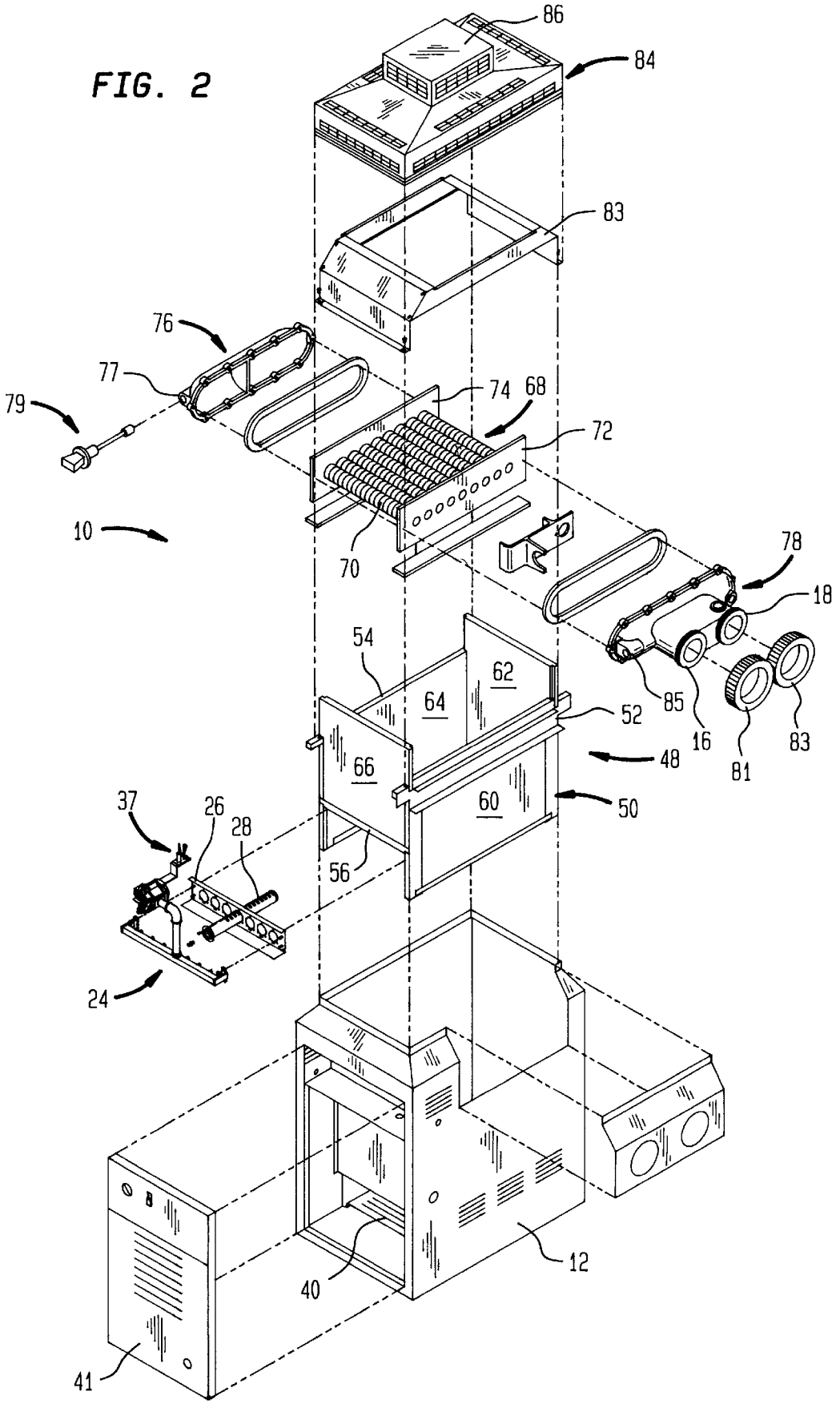
FIG. 2 is an exploded view of the heater shown in FIG. 1.

FIG. 2 shows various internal components of the heater 10. A burner assembly 24 includes a mounting plate 26 with a plurality of apertures therein for receiving burner tubes 28. As can be more readily seen in FIG. 3, the burner tubes 28 have multiple gas outlets 30 along an upper surface thereof from which a mixture of air and gas is discharged for burning. The burner tubes 28 may be formed from sheetmetal, preferably stainless steel, and include a flange 32 at one end for mounting to the mounting plate 26 via threaded fasteners 33, rivets or the like. To insure proper orientation of the burner tubes 28, i.e., with the gas outlets 30 pointing upward, each is provided with a key prominence 34 (shown in dotted lines) incorporated into the tube 28 and/or flange 32. A mating slot 36 is cut into the mounting plate 26 to receive the key 34. To assemble the burner assembly, one simply slides each burner tube 28 through a mating aperture in the mounting plate 26 with key 34 and slot 36 aligned, until the flange 32 bottoms against the mounting plate 26. The flange 32 is then attached to the mounting plate 26 by screws, rivets, spot welding or by bending tabs formed in the flange through mating apertures, as is conventional in attaching sheetmetal components. A conventional gas igniter 37 may be mounted on the burner assembly 24, such that the ignition end is disposed over the gas outlets 30 of the burner tubes 28. One can appreciate that a burner assembly 24 in accordance with the present invention is easy to install in the heater housing with fewer fasteners and provides a simplified mounting of the ignition system.

Referring again to FIG. 2, the burner assembly 24 is received within a bay 40 provided in the bottom of the housing 12 where it is attached via the mounting plate 26 to peripheral surfaces of the bay 40 opening by screws, bolts or other removable fasteners that enable the assembly 24 to be removed from the heater 10 for service or inspection through access panel 41. It is preferred that all parts of the burner assembly 24 be formed from stainless steel or other corrosion resistant material. In accordance with the present invention, the burner assembly 24 is cantilevered, being supported at only one end by the attachment of the mounting plate 26 to the heater housing 12 or the combustion chamber as described below.

Figure 3:
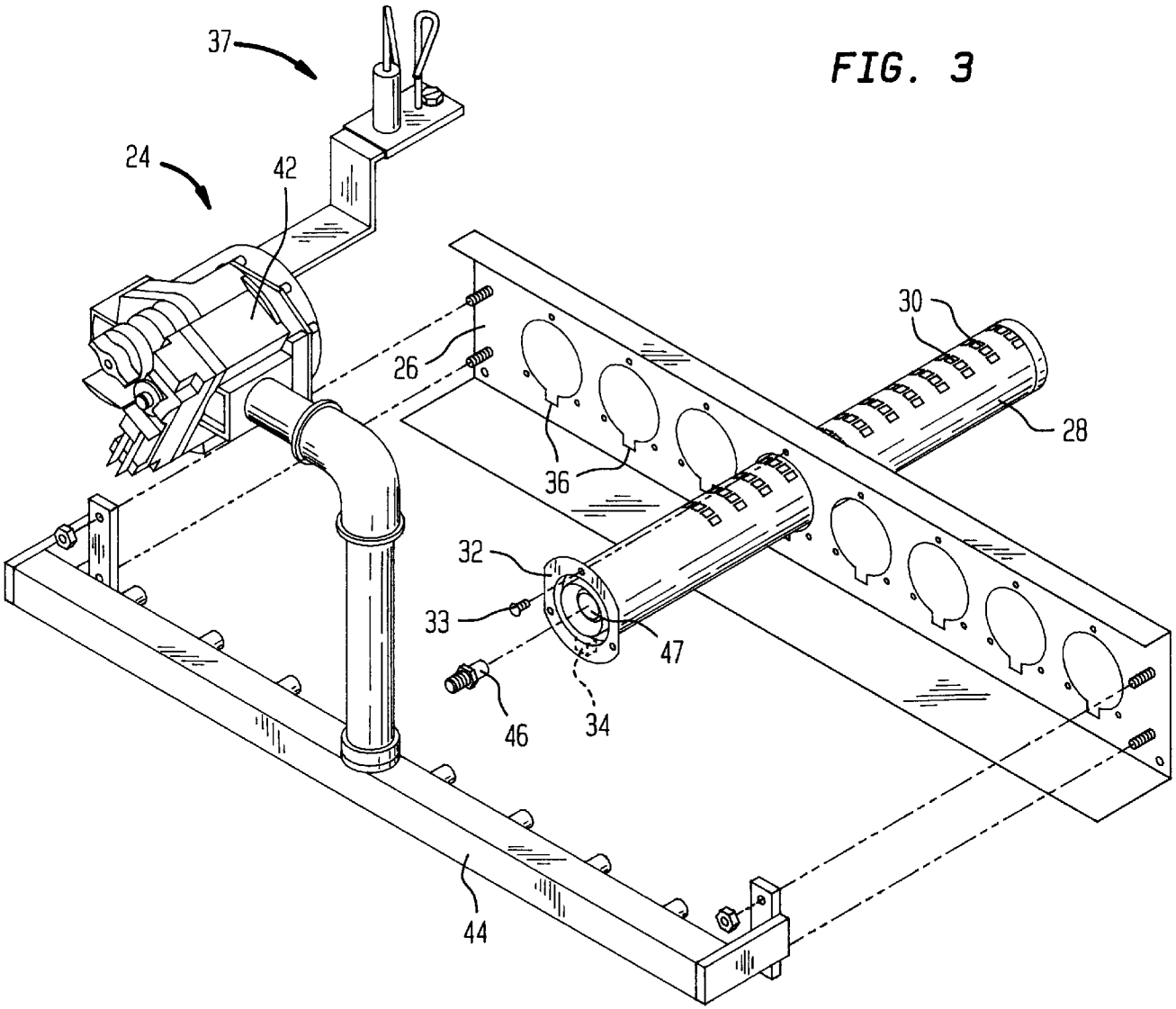
FIG. 3 is an enlarged exploded view of the burner assembly of the heater of FIG. 2.

As shown in FIG. 3, conventional gas valve 42 supplies fuel to a gas manifold 44 from which projects a plurality of gas nipples 46. The gas manifold 44 is mounted to the mounting plate 26. The nipples 46 of the manifold are concentric with inlet apertures 47 in the burner tubes 28 of the burner assembly 24 and are spaced away from the inlet apertures 47 by a short distance, e.g., on the order of a half inch. Gas discharged under pressure from the supply nipples 46 traverses the space between the nipples 46 and the inlet apertures 47 of the burner tubes 28 entraining air for combustion. In this manner, a direct mechanical linkage between the nipples 46 and the burner tubes 28 is eliminated, simplifying assembly.

Figure 4:
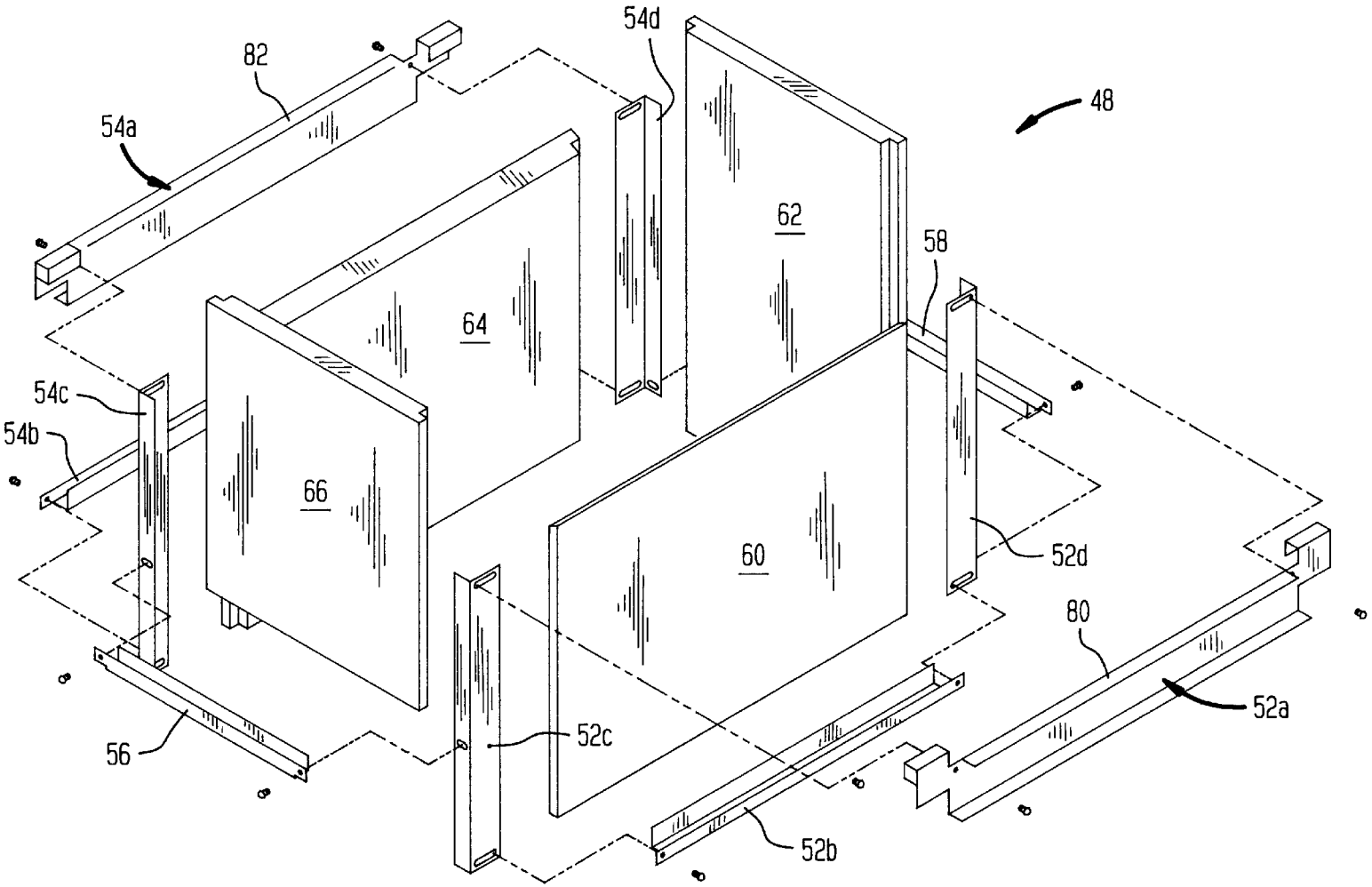
FIG. 4 is an enlarged exploded view of the combustion chamber assembly of the heater of FIG. 2.

Referring to FIGS. 2 and 4, a free-standing combustion chamber assembly 48 is inserted into the housing 12 straddling the burner assembly 24. The combustion chamber assembly 48 is dimensioned to fit snugly against the housing 12 proximate the periphery of the burner bay 40 to insure against loss of heat and combustion gases. However, the natural upward flow of gases in the combustion chamber 48 creates a suction, such that air-tight sealing against the burner bay 40 is not absolutely necessary. The combustion chamber assembly 48 includes a metal framework 50 having at least two side frame members 52, 54 (composed of subframe numbers 52*a*, 52*b*, 52*c* and 52*d* and 54*a*, 54*b*, 54*c* and 54*d*, respectively). The side frame members 52, 54 are connected together by front and rear frame members 56, 58. The framework 50 accommodates a plurality of refractory panels 60, 62, 64, 66 which may be formed of traditional refractory materials. Preferably, the lighter weight fibrous ceramic insulation panels currently available from the assignee of the present invention, under the trademark FIRETILE® are employed. The panels 60, 62, 64, 66 are supported in the framework 50 such that three, 60, 62, and 64 extend downwards to the bottom of the heater housing 12, with the fourth, 66 having a lesser lower extension to accommodate the burner tubes 28 of the burner assembly 24. The upper portions of the refractory panels 60 and 64 are coextensive, as are panels 62 and 66, with the second set, i.e, 62 and 66 extending above the upper peripheral edge of the first set. In this manner, the combustion chamber assembly 48 forms an insulated support for the heat exchanger 68, as shall be described further below. The framework 50 is assembled with conventional fasteners and/or by welding. At least one dimension of the framework 50, e.g., the width, is adjustable. For example, holes in the framework for accommodating bolts that connect the side frame members 52, 54 to front and rear frame members 56, 58 may be slotted. In the alternative, the fasteners, e.g., bolts, may tighten in a direction parallel to the dimension which is adjustable. Adjustability of the framework 50 enables the refractory panels 60, 62, 64, 66 to be slid into place in the framework 50 and then urged together under compressive force whereupon the fasteners are tightened. This clamping action of the framework 50 on the refractory panels 60, 62, 64, 66 insures a tight sealing of the panels one against another, avoiding the necessity for refractory cement to be applied to the joint between panels, or for the panel edges to be shaped in the form of tongue and groove or other joindery shapes, as was previously required. For example, slotted holes in framework members 52*c*, 52*d*, 54*c* and 54*d* permit those members to be urged together in a direction parallel to members 56 and 58 by temporary clamps. This clamping presses the outer peripheral side edges of, e.g., panels 62, 66 tightly against the inner peripheral faces of panels 60, 64. Bolts passing through 56 and 58 and the slotted holes in framework members 52*c*, 52*d*, 54*c*, 54*d* can then be tightened and the temporary assembly clamp removed. One can appreciate that the freestanding combustion chamber assembly 48 provides ease of assembly as well as a strongly integrated combustion chamber with relatively few parts and fasteners.

Referring back to FIG. 2, the heat exchanger 68 is positioned over the combustion chamber assembly 48 for absorbing the heat of combustion and includes a plurality of finned tubes 70, e.g., nine in number, through which the water to be heated is passed in circuitous fashion. A pair of endplates 72, 74 are soldered, welded or otherwise affixed in water-tight fashion on each terminal end of the tube set, unifying the tubes into an integrated assembly. A rear header 76 and front header 78 are bolted to the endplates 72, 74 respectively, to complete the heat exchanger 68. The rear header 76 has a threaded aperture 77 for receiving a pressure-sensitive switch 79 which when sensing water pressure, closes and allows heater operation. Water inlet 16 and outlet 18 may be externally threaded to receive a corresponding pair of union nuts 81, 83. Numerous other conventional couplings could also be used for this purpose, such as a pair of bolted flanges or a threaded nipple and socket, as is known to those of normal skill in the art. The front header 78 (or rear header 76) may be provided with a threaded aperture 85 to receive a temperature sensor for thermostatic control of the heater for maintaining a desired water temperature. The front header also accommodates a pressure sensitive bypass and an internal thermostatic valve as more fully described below in reference to FIG. 5.

As noted above, the refractory panels 60, 62, 64, 66 of the combustion chamber assembly 48 are configured to receive and support the heat exchanger 68. More specifically, refractory panels 62, 66 extend beside and above the heat exchanger tubes to at least the upper edge of the endplates 72, 74. Refractory panels 60, 64 are contacted by and partially support the heat exchanger tubes 70, with the endplates 72, 74 slipping along the outer upper surface thereof to come to rest on ledges 80, 82 (See FIG. 4) provided on combustion chamber frame members 52, 54. Fibrous refractory panels are deformable, such that the upper edges of panels 60, 64 conform to the shape of the heat exchanger tubes 70 contacting them. The vertical extent of the refractory panels 60, 64 up to the heat exchanger tubes and inside the endplates 72, 74 insulates the endplates and the front and rear headers 78, 76 from hot combustion chamber gases which could otherwise melt, deform or reduce the service life thereof. A flue collector 83 channels the combustion gases upwards into an exhaust vent or flue pipe. The housing 12 is completed by a top panel 84 which accommodates a vented cap 86. A number of conventional parts such as temperature control, pressure control switch and ignition control components have not been depicted for ease of illustration, but are well known to those of normal skill in the heater art.

Figure 5:
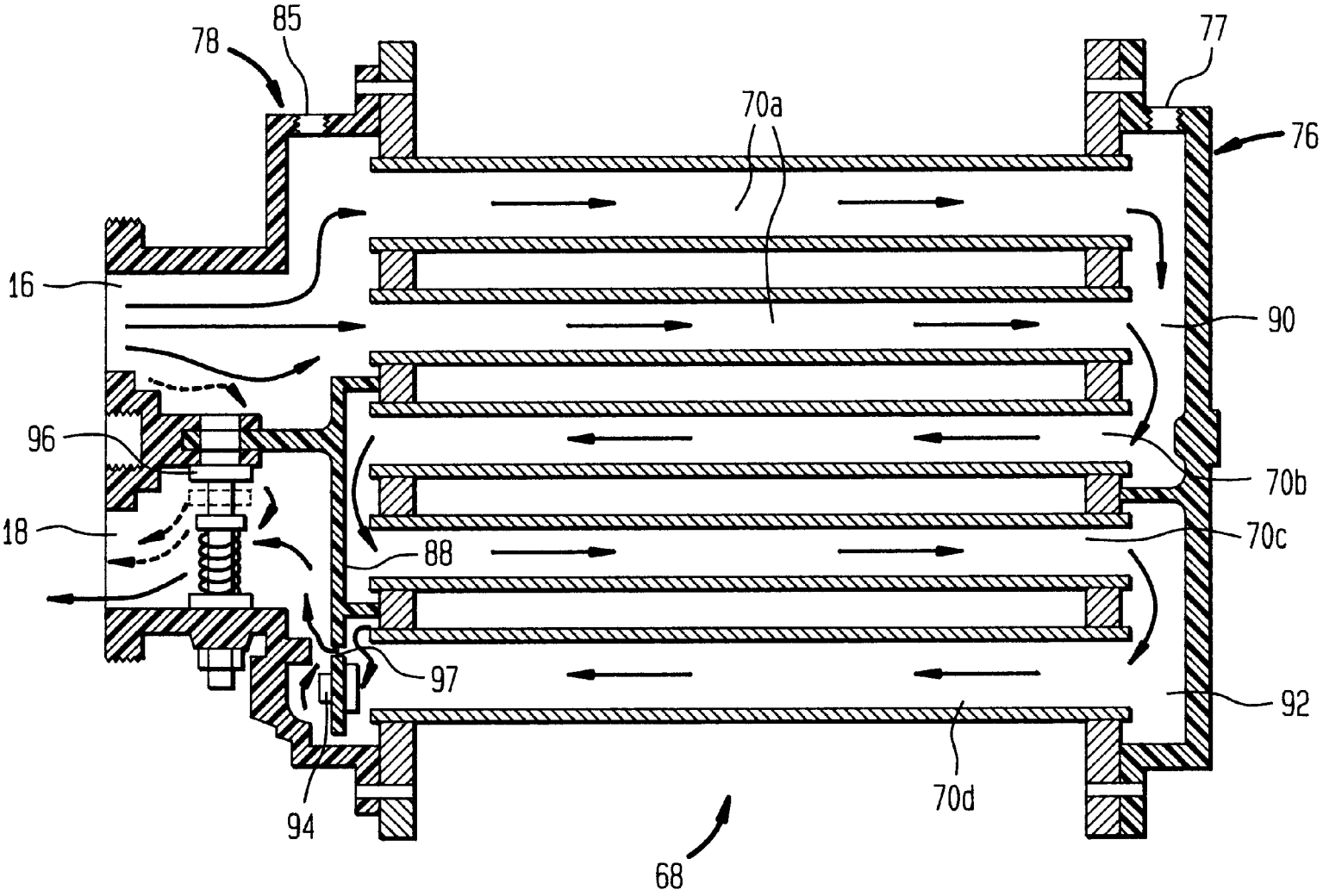
FIG. 5 is an enlarged, cross-sectional view of the heat exchanger unit of the heater of FIG. 2 taken along section line V—V, looking in the direction of the arrows and showing the flows therethrough diagrammatically.

FIG. 5 shows the heat exchanger 68 in cross section and diagrammatically depicts fluid flows therethrough. A flow of fluid to be heated enters the inlet port 16 of the front header 78 and around the left side of a baffle plate 88 (see FIG. 6) that is used to subdivide the interior hollow of the front header into a plurality of chambers. The fluid flows into a first heat exchanger tube or set of tubes 70*a* for the first pass over the combustion chamber. The rear header 76 defines a hollow chamber that is divided into two or more portions 90, 92. The water fills the first chamber 90 of the rear header 76 and is redirected through a second tube or set of tubes 70*b* back towards the front header 78 where it is subsequently redirected by the baffle plate 88 back through a third tube or set of tubes 70*c* to the second chamber 92 of the rear header 76. Upon leaving the second chamber 92 of the rear header 76, the water passes through a fourth tube or set of tubes 70*d* for its third pass over the combustion chamber and out the outlet port 18 into piping leading to the pool. While only three passes are described herein, it can be appreciated that more or less passes can be made simply by changing the number of tubes and corresponding subdivisions in the headers. Typically, both headers 76, 78 are formed from metal, such as cast iron. In accordance with the present invention, however, both headers 76, 78, or at least the front header 76, are formed from a plastic, such as glass-filled nylon. Plastics of this sort have beneficial properties for this application, viz., ease of manufacture, low cost, improved heat dissipation, low weight and compatibility with the thermal expansion rates of plastic piping systems to which the inlet 16 and outlet 18 are attached. The latter attribute of a plastic header permits threaded plastic-to-plastic connections to be used. In addition to the foregoing, a plastic header lends itself to the use of an o-ring seal rather than a full face gasket, as is used with metal headers. Probably most significantly, a plastic header is resistant to corrosion. Because of the manufacturing process employed to form plastic headers, viz., injection molding, the interior contours of the header are smoother, promoting better flow characteristics. It is also easier to install the baffle plate 88 for subdividing the front header, if the header is plastic, as shall be appreciated from the description of the invention relative to FIG. 6.

In further reference to FIG. 5, a thermostat 94 prevents water from exiting the heat exchanger 68 until it has reached a predetermined temperature, whereupon the thermostat 94 opens and allows the water to flow out the outlet port 18. Prior to the opening of the thermostat 94, water under pressure entering the inlet port 16 is shunted to the outlet port 18 under the control of a bypass valve 96 which opens to relieve the fluid pressure resulting from a closed thermostat 94. The bypass valve 96 prevents the fluid pressure inducer, i.e., a pump, from experiencing excessive loading. In addition to the bypass valve 96, a bleed port 97 (see FIG. 6) in the baffle plate 88 passes a controlled minimum bypass flow past the thermostat to prevent excessive pressure from building up behind the thermostat. The baffle plate 88 is captured between the header and the endplate 72 of the tubesheet.

The baffle plate 88 configuration shown facilitates the installation of the bypass valve 96 into the header 76, in that the installer can insert the bypass valve 96 into the header prior to the installation of the baffle plate 88. This method of installation avoids the awkward alternative of manipulating the valve by a hand or tool inserted through the outlet port 18, as in the case of headers utilizing an integrally cast or fixed baffle plate. The front header may include a threaded aperture 85 to receive a thermometer bulb. A similar threaded aperture 77 is provided in the rear header to accommodate a pressure sensitive switch.

Figure 6:
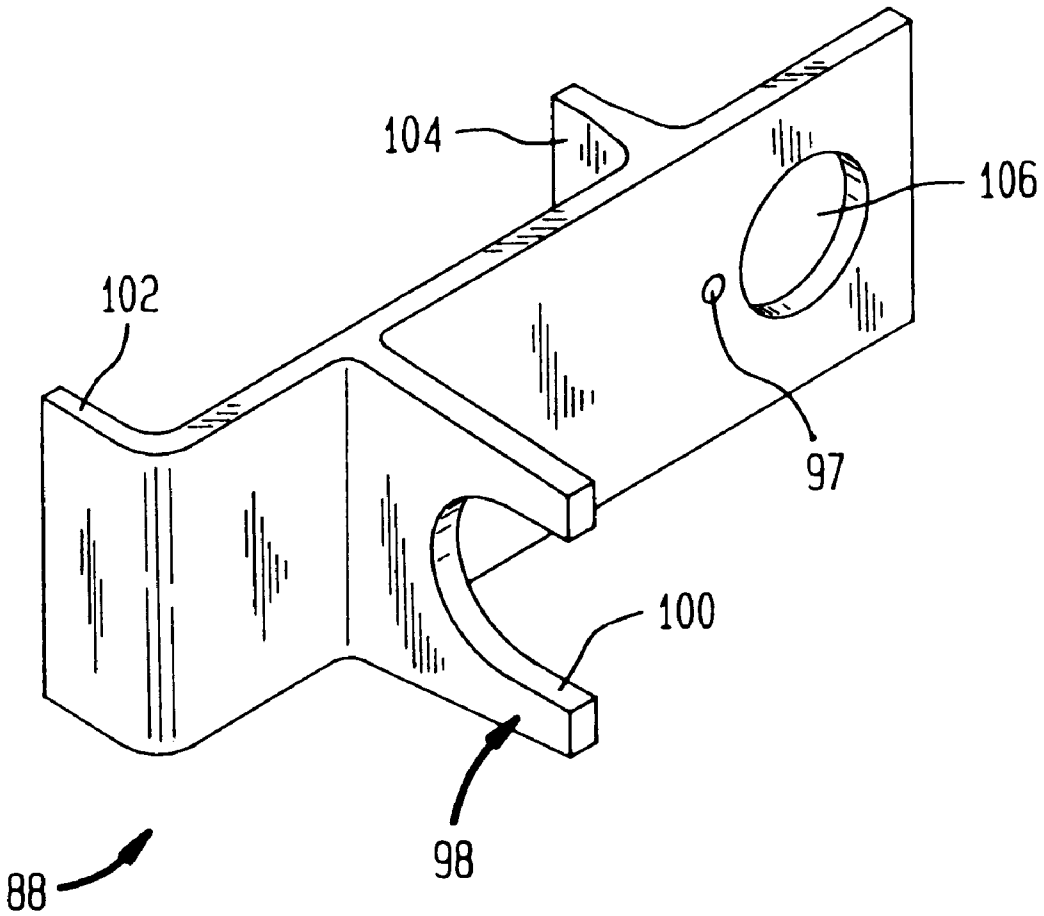
FIG. 6 is an enlarged perspective view of the baffle plate shown in FIG. 2.

FIG. 6 shows a plastic baffle plate 88 that is inserted into the front header 78 to divert flows through the header, more specifically, to induce the circuitous flow of fluid through the heat exchanger tubes 70. The baffle plate 88 has a tailpiece 98 that divides the inlet portion 16 of the header 78 from the outlet portion 18. The tailpiece 98 is molded with a scallop 100 at the end, which, when the baffle 88 is inserted in the header manifold 78, constitutes a port through which fluid under pressure may pass under the control of the by-pass valve 96, as described above. A pair of tines 102, 104 point towards the heat exchanger tubes 70 and serve to redirect fluid flow through the tubes, effectively sealing off one set of tubes from another. An aperture 106 at one end of the baffle plate receives the thermostat 94 for controlling flow through the heat exchanger core to the outlet port 18. The bleed port 97 permits a minimum bypass flow at all times, as noted above.

Figure 7:
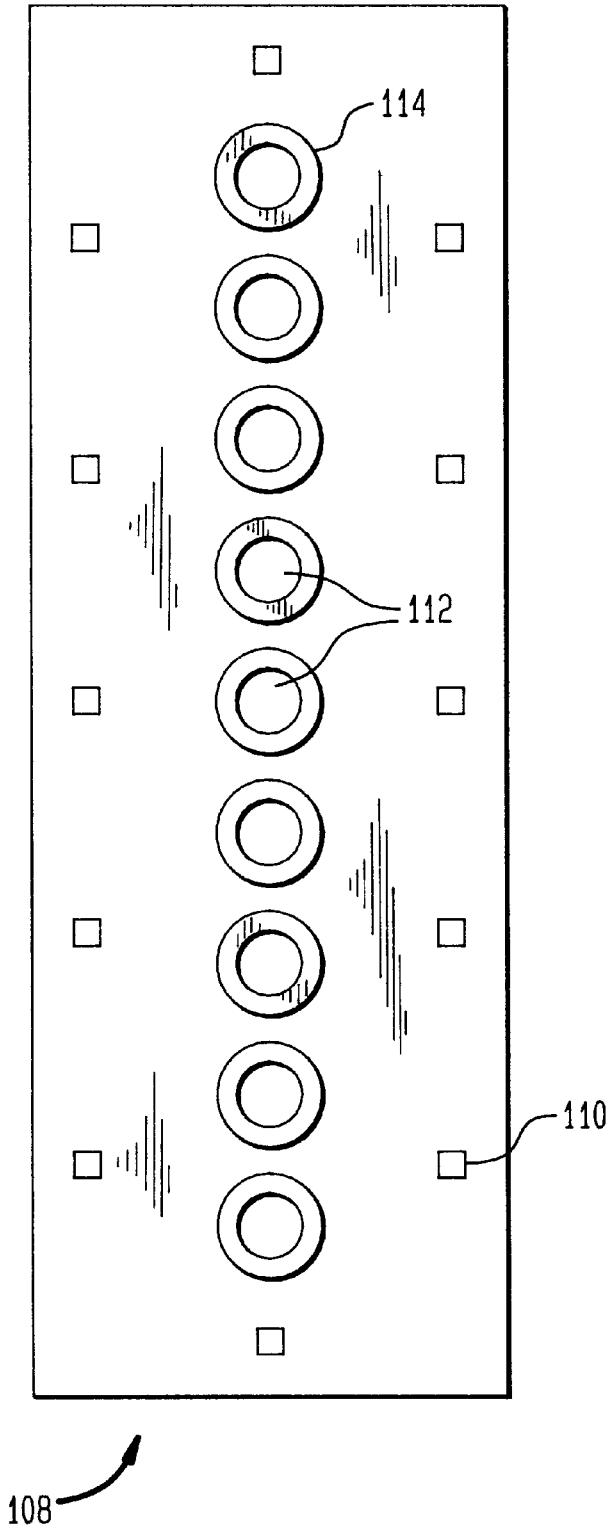
FIG. 7 is a plan view of a tube sheet in accordance with an alternative embodiment of the present invention.

FIG. 7 shows an alternative tubesheet (endplate) 108 for receiving the tubes 70 of the heat exchanger. Of course, a pair of tubesheets 108 would be required for the embodiment shown in FIG. 2. The tubesheet 108 is preferably formed from a thin plate or sheet of stainless steel, e.g., 0.188" and includes punched orifices 110 for receiving the mating shaft of suitable bolts or studs used for holding the headers 76, 78 in sealing engagement with the tube sheets. Other fasteners could be employed, such as a peripheral clamp which is crimped around the periphery of the header-manifold junction. The tubes 70 can be sealed in the tube holes 112 by internal expansion, welding, soldering or gluing, as is known in the art, and are preferably made from a material which does not corrode significantly when exposed to water, such as copper, stainless steel, or brass. The tube holes are preferably provided with surrounding flanges 114 for increasing the area of contact of the tube hole 112 against the tubes 70.

Figure 8:
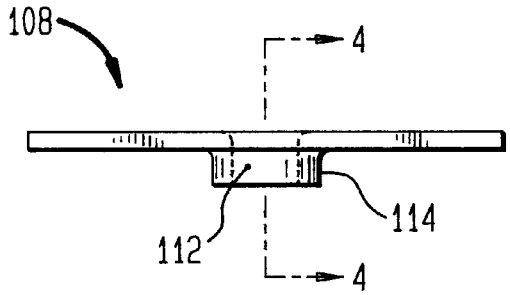
FIG. 8 is a side view of the tube sheet of FIG. 7.

The configuration of the tubesheet 108 can be appreciated more fully by examining FIG. 8 which shows a flange 114 protruding from the surface of the tube sheet. The flange roughly doubles the internal contact surface area of the generally cylindrical tube hole 112. This increase in surface area contact permits a thin sheet to provide an equivalent tube contact area as a thick plate. For example, a flange length of 0.5" may be achieved for a 0.75" tube hole in a 0.188" thick tube sheet. The increased contact area provided by the tubesheet flanges 114 also allows an expanded tube-to-tubesheet joint, i.e., without the use of solder, welding or other sealing means. This is beneficial in that soldering and welding operations are expensive and time consuming and also restrict the material composition of the tubes relative to a stainless steel tubesheet 108. For example, copper, a traditional tube 70 composition, is generally incompatible with stainless steel for soldering and welding operations.

Figure 9:
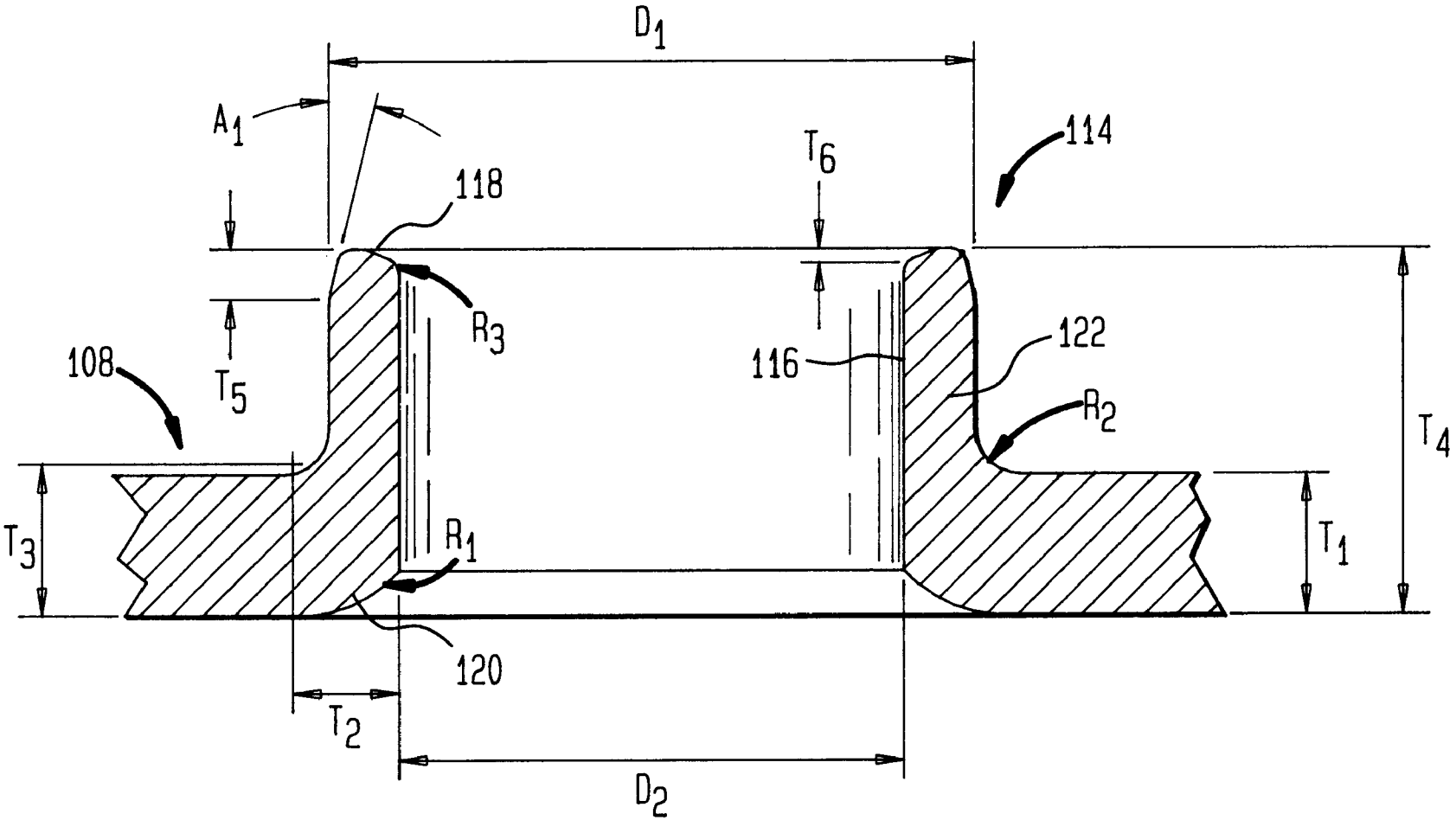
FIG. 9 is an enlarged, cross-sectional view of a tube hole flange of the tube sheet of FIG. 8 taken along section lines IX—IX and looking in the direction of the arrows.

FIG. 9 shows a preferred configuration for the tube hole flanges 114 which includes a cylindrical area 116 bounded by a tapered threshold on either side 118, 120. The flange wall 122 is thinner than the remainder of the tubesheet 108 by a factor of about 50%. The flange projects from the surface of the tubesheet 108 by a distance slightly greater than the thickness of the tubesheet. To form the tubehole flange shape shown in FIG. 9, a small circular hole is punched or bored in the tubesheet. The tubesheet is then placed between a pair of complementary nitrided dies having a cavity therebetween in the closed position approximating the shape of the flange shown. The dies are urged together with a force sufficient to cause a flowing of the tubesheet metal into the desired shape. Accordingly, the flanges are not simply bent into position but are forged or swaged by fluid deformation of the tubesheet metal.

An exemplary set of dimensions for the flange shown in FIG. 9 would be as follows: Diameter $D_1$=0.938", $D_2$=0.741", Radius $R_1$=0.203", $R_2$=0.063", $R_3$=0.031", Thickness $T_1$=0.189", $T_2$=0.144", $T_3$=0.203", $T_4$=0.473", $T_5$=0.063", $T_6$=0.025" and angle $A_1$=13°.

When a stainless steel, sheet metal tube sheet is used in combination with expanded copper or stainless steel tubes and plastic headers, an economical, corrosion resistant heat exchanger is produced. The combination is much lighter than known heat exchangers for use in a gas fired water heater and is particularly suitable for use in swimming pool and spa heaters where corrosion of metal parts in the heater translate into discolored pool water, as well as mineral deposits and stains on pool and spa walls. The tubesheet may be assembled to the tubes with the flanges protruding in the direction of the header, i.e., towards the "wet side". In this manner of assembly, the protruding stainless steel flanges protect the portion of the copper tubes which protrude into the header by diverting corrosive fluid flows away from the tubes.

It should be understood that the embodiments described herein are merely exemplary and that a person skilled in the art may make many variations and modifications without departing from the spirit and scope of the invention as defined in the appended claims.

We claim:

1. A fluid heater comprising:

(a) a housing;

(b) a burner unit disposed in a bottom portion of said housing for burning combustible fuel;

(c) a combustion chamber disposed within said housing where said combustible fuel is burned; and (d) a heat exchanger disposed substantially within said housing over said combustion chamber, said heat exchanger absorbing heat generated from burning said combustible fuel and conducting the heat to a fluid to be heated, said heat exchanger including a pair of spaced, parallel, stainless steel tubesheets with a plurality of tubes running therebetween and sealingly received within mating apertures in each of said tubesheets, a front header and a rear header removably attached to said tubesheets distal to said tubes, said heat exchanger having an inlet and an outlet for receiving and discharging, respectively, the fluid to be heated, said front header and said rear header being composed of plastic.

2. The heater of claim 1, wherein said heat exchanger is at least partially exposed to the direct heat of burning said combustible fuel.

3. The heater of claim 2, wherein said tubesheets are at least partially shielded from the direct heat of burning by an insulator.

4. The heater of claim 3, wherein said insulator is a portion of said combustion chamber.

5. The heater of claim 4, wherein said tubesheets straddle said combustion chamber.

6. The heater of claim 2, wherein said mating apertures are each defined, at least in part, by a flange protruding from a corresponding one of said tubesheets.

7. The heater of claim 6, wherein each of said flanges is generally cylindrical and extends perpendicularly from its corresponding tubesheet.

8. The heater of claim 7, wherein each of said flanges has a chamfer around an inner peripheral edge thereof for aiding in the introduction of an associated said tube.

9. The heater of claim 6, wherein each of said flanges has a wall thickness that is less than the thickness of its corresponding tubesheet.

10. The heater of claim 9, wherein each of said flanges extends from the surface of its corresponding tubesheet to an extent greater than the thickness of said corresponding tubesheet.

11. The heater of claim 6, wherein each of said flanges is forged.

12. The heater of claim 2, wherein said tubes are copper.

13. The heater of claim 2, wherein said tubes are sealed to said apertures in said tubesheets by expansion.

14. The heater of claim 2, wherein said front header and said rear header are each sealingly engaged to a corresponding one of said tubesheets by fastening means and an o-ring.

15. The heater of claim 2, wherein said front header includes a plastic baffle plate therein for directing fluid flows through said heat exchanger, said plastic baffle plate dividing said front header into an input portion and an output portion and having an aperture forming a by-pass port from said input portion to said output portion, and further including a pressure activated by-pass valve responsive to fluid pressure for controlling fluid through said by-pass port.

16. A method of fabricating a heat exchanger, comprising the steps of:

(a) making a plurality of apertures in a pair of corrosion-resistant metal plates;

(b) swaging flanges in said metal plates surrounding said apertures, said step of swaging including the steps of successively placing each of said metal plates between a pair of mating dies and urging said dies together to form said flanges through a flowing of the metal of said metal plate;

(c) inserting a first end of each of said tubes into a corresponding said flanged aperture in a first of said pair of plates;

(d) inserting a second end of each of said tubes into a corresponding said flanged aperture in a second of said pair of plates; and (e) sealingly installing headers on either side of said assembly resulting from steps (a) through (c) to form a heat exchanger.

17. The method of claim 16, further including the steps of expanding said tubes after each of said steps (c) and (d).

18. A corrosion resistant heat exchanger, comprising:

(a) a pair of spaced, parallel, stainless-steel tubesheets with a plurality of corrosion-resistant tubes running therebetween and sealingly received within mating apertures in each of said tubesheets;

(b) a plastic front header; and (c) a plastic rear header, said front header and said rear header sealingly attached to a corresponding one of said tubesheets, one of said headers having an inlet and one of said headers having an outlet for fluid, said mating apertures having forged flanges for increasing the area of contact between said tubesheets and said tubes, said tubes being internally expanded in said apertures.

19. The heat exchanger of claim 18, wherein each of said flanges is generally cylindrical and extends perpendicularly from a corresponding one of said tubesheets.

20. The heat exchanger of claim 19, wherein each of said flanges has a wall thickness that is less than the thickness of its corresponding tubesheet and an extent greater than the thickness of said corresponding tubesheet.

21. The heat exchanger of claim 18, wherein each of said flanges protrudes towards an associated header.

22. A fluid heater comprising:

(a) a metal housing;

(b) a burner unit disposed in a bottom portion of said housing for burning combustible fuel;

(c) a freestanding box-shaped combustion chamber having an open top and bottom disposed within said housing where combustible fuel is burned, said combustion chamber including four refractory panels and a metal framework, which is adjustable in at least one dimension, for holding said refractory panels in position relative to each other to form said combustion chamber and for urging said refractory panels into engagement with one another such that each panel sealingly engages an adjacent panel proximate longitudinal peripheral edges thereof to prevent the escape of heat and combustion products from said combustion chamber, said framework being adjustable via slotted holes that are elongated in the direction of adjustability, said holes receiving fasteners for retaining said refractory panels in their positions relative to each other, said fasteners being positioned in said elongated holes in selected positions associated with a given framework dimension and tightened to maintain them in said positions; and (d) a heat exchanger disposed substantially within said housing over said open top of said combustion chamber, said open bottom receiving heat from said burner unit generated from burning combustible fuel, said heat exchanger absorbing and conducting heat to a fluid to be heated.

23. A fluid heater comprising:

(a) a metal housing;

(b) a burner unit disposed in a bottom portion of said housing for burning combustible fuel;

(c) a freestanding box-shaped combustion chamber having an open top and bottom disposed within said housing where combustible fuel is burned, said combustion chamber including four refractory panels and a metal framework, which is adjustable in at least one dimension, for holding said refractory panels in position relative to each other to form said combustion chamber and for urging said refractory panels into engagement with one another; and (d) a heat exchanger disposed substantially within said housing over said combustion chamber, said open bottom receiving heat from said burner unit and said open top accommodating said heat exchanger thereover such that said heat exchanger absorbs heat generated from burning combustible fuel and conducts heat to a fluid to be heated, said refractory panels including a pair of matched side panels of substantially equal dimensions, each extending from a bottom reference plane upwards to a first and second upper edge, respectively, a front panel extending from a first lower edge positioned above said first lower reference plane to a third upper edge extending above said first and second upper edges of said side panels, and a back panel extending from said bottom reference plane to a fourth upper edge extending to a height approximating that of said third upper edge, at least a portion of said burner unit being accommodated into said combustion chamber through a space between said first lower edge and said bottom reference plane, said space being further delimited by said side panels and said back panel, said heat exchanger being received between said front and rear panels and including a pair of spaced, parallel endplates with a plurality of tubes running therebetween and sealingly received within mating apertures in each of said endplates, a front header and a rear header removably attached to said endplates distal to said tubes for forming a circuitous conduit through said heat exchanger, said endplates straddling said side panels with said tubes contacting said first upper edge and said second upper edge, and said framework including a pair of sideframe members, each of which supports a corresponding one of said side panels and includes a ledge for supporting a corresponding one of said endplates.

24. A fluid heater comprising:

(a) a metal housing;

(b) a burner unit disposed in a bottom portion of said housing for burning combustible fuel;

(c) a freestanding box-shaped combustion chamber having an open top and bottom disposed within said housing where combustible fuel is burned, said combustion chamber including four refractory panels and a metal framework, which is adjustable in at least one dimension, for holding said refractory panels in position relative to each other to form said combustion chamber and for urging said refractory panels into engagement with one another; and (d) a heat exchanger disposed substantially within said housing over said combustion chamber, said open bottom receiving heat from said burner unit and said open top accommodating said heat exchanger thereover such that said heat exchanger absorbs heat generated from burning combustible fuel and conducts heat to a fluid to be heated, said refractory panels including a pair of matched side panels of substantially equal dimensions, each extending from a bottom reference plane upwards to a first and second upper edge, respectively, a front panel extending from a first lower edge positioned above said first lower reference plane to a third upper edge extending above said first and second upper edges of said side panels, and a back panel extending from said bottom reference plane to a fourth upper edge extending to a height approximating that of said third upper edge, at least a portion of said burner unit being accommodated into said combustion chamber through a space between said first lower edge and said bottom reference plane, said space being further delimited by said side panels and said back panel, said heat exchanger being received between said front and rear panels and including a pair of spaced, parallel endplates with a plurality of tubes running therebetween and sealingly received within mating apertures in each of said endplates, a front header and a rear header removably attached to said endplates distal to said tubes for forming a circuitous conduit through said heat exchanger, said front header receiving a plastic baffle plate in an interior hollow thereof for directing fluid flows through said heat exchanger, said plastic baffle plate having an elongated member from which a tailpiece extends in a first direction at approximately 90 degrees, said elongated member having at least one tine extending therefrom in the direction opposite to the tailpiece at 90 degrees to said elongated member, said tailpiece dividing said front header into an input portion and an output portion, said tine partitioning said front header into a plurality of chambers for directing a flow of said fluid to be heated through said tubes in circuitous fashion.

25. The heater of claim 24, wherein said tailpiece has an aperture at an end thereof distal to said elongated member, said tailpiece aperture forming a by-pass port from said input portion to said output portion, said by-pass port occluded by a by-pass valve responsive to fluid pressure for controlling fluid flow through said by-pass port, said heat exchanger further including a thermostat mounted in an aperture formed in said elongated member of said baffle plate and discharging into said outlet portion, said thermostat controlling the flow of fluid through said heat exchanger tubes into said outlet portion depending upon the temperature of said fluid.

26. A fluid heater comprising:

(a) a metal housing;

(b) a burner unit disposed in a bottom portion of said housing for burning combustible fuel, said burner unit being mounted in cantilever fashion to said metal housing;

(c) a combustion chamber disposed within said housing where combustible fuel is burned;

(d) a heat exchanger disposed substantially within said housing over said combustion chamber, said heat exchanger absorbing heat generated from burning said combustible fuel and conducting heat to a fluid to be heated.

27. The heater of claim 26, wherein said burner unit includes a mounting plate, each of a plurality of apertures therein receiving a burner tube concentrically therein, each of said burner tubes having a flange at one end that attaches to said mounting plate via attaching means.

28. The heater of claim 27, wherein said burner tubes have a fuel inlet orifice at one end and a plurality of fuel outlet orifices along an upper surface thereof, said attaching means configured to orient said tubes with said fuel outlet orifices in an upward orientation.

29. A fluid heater comprising:

(a) a metal housing;

(b) a burner unit disposed in a bottom portion of said housing for burning combustible fuel, said burner unit being mounted in cantilever fashion to said metal housing and including a mounting plate, each of a plurality of apertures therein receiving a burner tube concentrically therein, each of said burner tubes having a flange at one end that attaches to said mounting plate via attaching means, said burner tubes having a fuel inlet orifice at one end and a plurality of fuel outlet orifices along an upper surface thereof, said attaching means configured to orient said tubes with said fuel outlet orifices in an upward orientation, said attaching means including a plurality of evenly spaced holes formed in said flange of each of said burner tubes and a corresponding set of holes formed in said mounting plate, and fastener means passing through said spaced holes and corresponding holes for fastening said burner tubes to said mounting plate, and further including first key means provided on each of said burner tubes, said first key means mating with second key means provided on said mounting plate for orienting said burner tubes with said fuel outlet orifices in an upward position.

30. The heater of claim 29, wherein said fastener means are removable to allow each of said burner tubes to be independently disengaged from said mounting plate.

31. The heater of claim 30, wherein said burner tubes extend at approximately 90 degrees relative to said mounting plate.

32. The heater of claim 31, wherein said housing has a burner bay opening in said bottom portion of said housing for accommodating said burner unit, said mounting plate being removably fastened to the periphery of said burner bay opening.

33. The heater of claim 32, further including an igniter mounted on said mounting plate such that an ignition end of said igniter extends in the direction of said burner tubes.

34. The heater of claim 33, further including a fuel supply manifold held in removable association with said burner unit and having an elongated fuel conduit from which extends a plurality of fuel discharge nipples along the length thereof, each of said nipples being coaxially oriented relative to said fuel inlet orifices of said burner tubes and being spaced therefrom such that fuel ejected from said nipples traverses the spacing between said nipples and said inlet orifices, simultaneously entraining air for combustion.

35. A fluid heater comprising:

(a) a metal housing;

(b) a burner unit disposed in a bottom portion of said housing for burning combustible fuel;

(c) a combustion chamber disposed within said housing where combustible fuel is burned; and (d) a heat exchanger disposed substantially within said housing over said combustion chamber, said heat exchanger absorbing heat generated from burning combustible fuel and conducting heat to a fluid to be heated, said heat exchanger including a pair of spaced, parallel endplates with a plurality of tubes running therebetween and sealingly received within mating apertures in each of said endplates, a front header and a rear header removably attached to said endplates distal to said tubes, said front header having an inlet orifice and an outlet orifice for receiving and discharging, respectively, fluid to be heated, said front header being composed of plastic.

36. The heater of claim 35, wherein said front header includes a plastic baffle plate therein for directing fluid flows through said heat exchanger.

37. The heater of claim 35, wherein said rear header is formed from plastic.

38. The header of claim 37, wherein said front header and said rear header are each sealingly engaged to an associated one of said endplates by fastening means and an o-ring.

39. A fluid heater comprising:

(a) a metal housing;

(b) a burner unit disposed in a bottom portion of said housing for burning combustible fuel;

(c) a combustion chamber disposed within said housing where combustible fuel is burned; and (d) a heat exchanger disposed substantially within said housing over said combustion chamber, said heat exchanger absorbing heat generated from burning combustible fuel and conducting heat to a fluid to be heated, said heat exchanger including a pair of spaced, parallel endplates with a plurality of tubes running therebetween and sealingly received within mating apertures in each of said endplates, a front header and a rear header removably attached to said endplates distal to said tubes, said front header having an inlet orifice and an outlet orifice for receiving and discharging, respectively, fluid to be heated, said front header being composed of plastic and including a plastic baffle plate therein for directing fluid flows through said heat exchanger, said plastic baffle plate having an elongated member from which a tailpiece extends in a first direction at approximately 90 degrees, said elongated member having at least one tine extending in the direction opposite to the tailpiece at 90 degrees, said tailpiece dividing said front header into an input portion and an output portion, said tine partitioning said front header into a plurality of chambers for directing a flow of said fluid to be heated through said tubes in circuitous fashion.

40. The heater of claim 39, wherein said baffle plate is captured between said front header and one of said endplates.

41. The heater of claim 40, wherein said tailpiece has an aperture at an end thereof distal to said elongated member, said aperture forming a by-pass port from said input portion to said output portion, and further including a by-pass valve responsive to fluid pressure for controlling fluid flow through said by-pass port.

42. The heater of claim 41, further including a thermostat mounted in an aperture formed in said elongated member of said baffle plate and discharging into said outlet portion, said thermostat controlling the flow of fluid through said heat exchanger tubes into said outlet portion depending upon the temperature of said fluid.

43. A hydrocarbon fuel-fired fluid heater, comprising a housing; a combustion chamber within said housing wherein hydrocarbon fuel is burned; a burner unit disposed proximate to said combustion chamber for burning hydrocarbon fuel; and a heat exchanger disposed at least partially within said housing and in communication with said combustion chamber, said heat exchanger being at least partially exposed to heat generated by the burning of hydrocarbon fuel, said heat exchanger absorbing heat from the burning of hydrocarbon fuel and conducting it to a fluid to be heated, said heat exchanger having a plurality of spaced, heat-conductive conduits through which fluid to be heated may pass, and at least one tube sheet with a plurality of apertures therethrough, said conduits attached to said tube sheet proximate said apertures with each of said conduits being in communication with an associated one of said plurality of apertures, said heat exchanger having a plastic header with an inlet and an outlet and at least two internal chambers contained therein, a first of said chambers in communication with said inlet and a second of said chambers in communication with said outlet.

44. The heater of claim 43, wherein a substantial portion of fluid to be heated flows through said inlet into said first chamber, through at least a portion of said plurality of conduits into said second chamber and out said outlet when said heater is operating.

45. The heater of claim 43, further including means for shielding said plastic header from heat of combustion present in said combustion chamber.

46. The heater of claim 43, wherein said tubesheet is made from corrosion resistant material.

47. A heat exchanger for use in a hydrocarbon fuel-fired fluid heater, comprising aplurality of spaced, heat-conductive conduits through which fluid to be heated may pass; at least one tube sheet with a plurality of apertures therethrough, said conduits attached to said tube sheet proximate said apertures with each of said conduits being in communication with an associated one of said plurality of apertures; a plastic header with an inlet and an outlet and at least two internal chambers contained therein, a first of said chambers in communication with said inlet and a second of said chambers in communication with said outlet, said plastic header sealingly attaching to said at least one tube sheet for controlling the flow of fluid through said plurality of conduits, said heat exchanger being capable of being subjected to heat from combustion of hydrocarbon fuel without melting said plastic header.

* * * * *

US006026804C1

(12) EX PARTE REEXAMINATION CERTIFICATE (10208th)

United States Patent
Schardt et al.

(10) Number: US 6,026,804 C1
(45) Certificate Issued: Jun. 27, 2014

(54) HEATER FOR FLUIDS

(75) Inventors: David L. Schardt, Brentwood, TN (US); Kendall R. Carter, Lascassas, TN (US); John M. Stallins, Louisville, KY (US); Charles E. Taylor, Ashland City, TN (US)

(73) Assignee: Hayward Industries, Inc., Elizabeth, NJ (US)

Reexamination Request:
No. 90/012,955, Aug. 21, 2013

Reexamination Certificate for:

| | |
|---|---|
| Patent No.: | **6,026,804** |
| Issued: | **Feb. 22, 2000** |
| Appl. No.: | **08/801,077** |
| Filed: | **Feb. 14, 1997** |

Related U.S. Application Data

(63) Continuation-in-part of application No. 08/579,692, filed on Dec. 28, 1995, now abandoned.

(51) Int. Cl.
*E01C 19/45* (2006.01)
*F24H 1/00* (2006.01)

(52) U.S. Cl.
USPC ..... 126/344; 165/133; 165/178; 165/173

(58) Field of Classification Search
None
See application file for complete search history.

(56) References Cited

To view the complete listing of prior art documents cited during the proceeding for Reexamination Control Number 90/012,955, please refer to the USPTO's public Patent Application Information Retrieval (PAIR) system under the Display References tab.

*Primary Examiner* — Joseph A. Kaufman

(57) ABSTRACT

A fluid heater includes a housing, a burner unit disposed in a bottom portion of the housing for burning combustible fuel, a combustion chamber disposed within the housing where the fuel is burned and a heat exchanger disposed substantially within the housing over the combustion chamber. The heat exchanger absorbs heat generated from burning the fuel and conducts the heat to a fluid to be heated. The heat exchanger includes a pair of spaced, parallel, stainless steel tubesheets with a plurality of tubes running therebetween and sealingly received within mating apertures in each of the tubesheets. A plastic front header and a plastic rear header are removably attached to the tubesheets distal to said tubes. The apertures in the tubesheets preferably have forged flanges for increasing the surface contact area with the heat exchanger tubes. The heat exchanger is corrosion resistant due to the combination of corrosion-resistant tubesheets, tubes and headers.

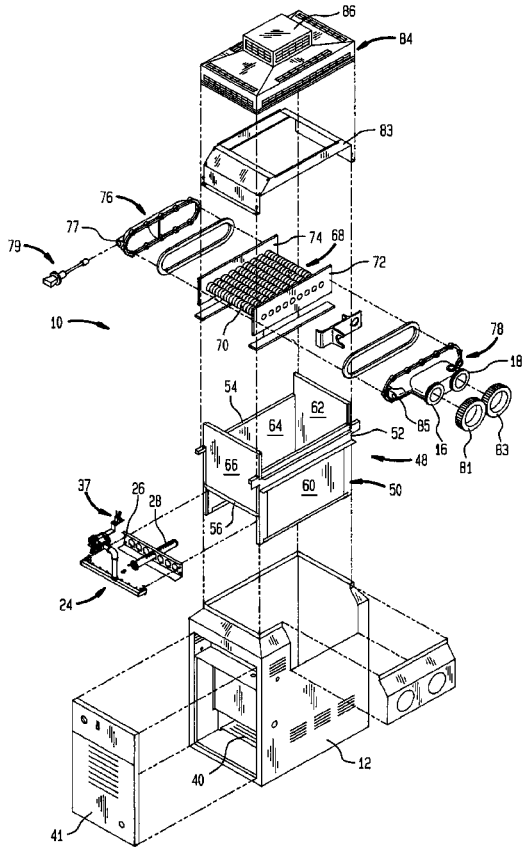

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 43-47 is confirmed.

Claims 1-42 were not reexamined.

* * * * *